US007854209B2

(12) United States Patent
Yamasaki

(10) Patent No.: US 7,854,209 B2
(45) Date of Patent: Dec. 21, 2010

(54) WORKPIECE CLOTH POSITIONING GUIDE DEVICE FOR SEWING MACHINE

(75) Inventor: Hiroshi Yamasaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 932 days.

(21) Appl. No.: 11/704,999

(22) Filed: Feb. 12, 2007

(65) Prior Publication Data

US 2007/0206371 A1 Sep. 6, 2007

(30) Foreign Application Priority Data

Mar. 3, 2006 (JP) ..... 2006-057286

(51) Int. Cl.
*D05B 35/12* (2006.01)

(52) U.S. Cl. ..... 112/444

(58) Field of Classification Search ..... 112/444, 112/445, 453, 456, 470.01, 470.04; 700/136
See application file for complete search history.

(56) References Cited

U.S. PATENT DOCUMENTS 4,821,657 A * 4/1989 Herdeg et al. ..... 112/470.04
5,042,410 A 8/1991 Nakashima
5,072,680 A * 12/1991 Nakashima ..... 112/445
5,195,451 A * 3/1993 Nakashima ..... 112/445
5,479,804 A * 1/1996 Cook ..... 72/31.02
6,161,491 A * 12/2000 Takenoya et al. ..... 112/445

FOREIGN PATENT DOCUMENTS

| | | |
|---|---|---|
| JP | U 59-69992 | 5/1984 |
| JP | A 5-269265 | 10/1993 |
| JP | A 05-337271 | 12/1993 |
| JP | B2 2775961 | 5/1998 |
| JP | A 11-47482 | 2/1999 |
| JP | A 2004-141198 | 5/2004 |
| JP | A 2005-58470 | 3/2005 |
| JP | A-2007-335293 | 12/2007 |

* cited by examiner

*Primary Examiner*—Gary L Welch
*Assistant Examiner*—Nathan E Durham
(74) *Attorney, Agent, or Firm*—Oliff & Berridge PLC

(57) ABSTRACT

A workpiece cloth positioning guide device for a sewing machine includes a projector which projects a sewing reference mark onto an upper side of workpiece cloth placed on a sewing bed of the sewing machine. The projector includes a telescopic cylindrical body having an upper end provided with the light source and a lower end, a transmission part provided in a lengthwise middle portion of the cylindrical body and formed with a mark forming pattern for forming the sewing reference mark, a projector lens provided in the lower end of the cylindrical body, and a projector lens elevating unit which raises and lowers the projector lens, and a mark size setting unit which sets a size of the circle of the sewing reference mark to a desired size.

6 Claims, 16 Drawing Sheets

WORKPIECE CLOTH POSITIONING GUIDE DEVICE FOR SEWING MACHINE

CROSS-REFERENCE TO RELATED APPLICATIONS

This application is based upon and claims the benefit of priority from the prior Japanese Patent Application No. 2006-57286 filed on Mar. 3, 2006, the entire contents of which are incorporated herein by reference.

BACKGROUND

1. Technical Field

The present disclosure relates to a workpiece cloth positioning guide device for a sewing machine, which projects a sewing reference mark onto an upper surface of workpiece cloth placed on a sewing bed of a sewing machine thereby to guide the positioning of the workpiece cloth in a sewing operation.

2. Description of the Related Art

In sewing workpiece cloth by a sewing machine, stitches are sometimes formed with a predetermined distance from an edge of the workpiece cloth or stitches previously formed on the workpiece cloth. There has conventionally been provided a device comprising a generally rectangular presser foot 100 as shown in FIG. 20, for example. In sewing, an edge 101*a* of workpiece cloth 101 is positioned relative to a side edge of the presser foot 100 so that, for example, the edge 101*a* of the workpiece cloth 101 corresponds with the side edge of the presser foot 100. When the workpiece cloth 101 is fed while the aforesaid state of the workpiece cloth 101 is maintained, stitches 102 are formed on the workpiece cloth 101 with the predetermined distance from the edge 101*a* of the workpiece cloth 101.

In another conventional example, for instance, stitches 107 previously formed on the workpiece cloth 106 are positioned relative to an outer circumference of a ring-shaped presser foot 105 in sewing as shown in FIG. 21. For example, the stitches 107 are positioned so as to lie adjacent to the outer circumference of the presser foot 105. When the workpiece cloth 106 is fed while the aforesaid state of the workpiece cloth 106 is maintained, stitches 108 are formed on the workpiece cloth 101 with a predetermined distance from the previously formed stitches 107.

On the other hand, Japanese Patent No. 2775961 discloses a sewing machine comprising a projector attached to a head of the sewing machine in order that stitches may be formed on workpiece cloth with a predetermined distance from an edge of the workpiece cloth. The projector has a light source, a liquid crystal panel and projector lens. The projector projects a linear sewing reference line serving as a mark to position an edge of the workpiece cloth.

However, as in the devices shown in FIGS. 20 and 21, the sewing machine head is located over the presser foot when the edge of the workpiece cloth or the previously formed stitches are to be positioned relative to the presser foot. As a result, the operator views the presser foot and the workpiece cloth from obliquely upward. In this case, the presser foot stands in the way of the operator's view. Moreover, the operator has difficulty in getting positions of the edge of the workpiece cloth and the previously formed stitches relative to the presser foot. Accordingly, it becomes difficult to position the edge of the workpiece cloth and the previously formed stitches accurately relative to the presser foot and further, to feed the workpiece cloth so that the edge of the workpiece cloth and the previously formed stitches are maintained at the positions.

Thus, it is difficult for the operator to form stitches with a predetermined stitch interval relative to the edge of the workpiece cloth or previously formed stitches.

Furthermore, since the stitch interval depends upon the size of the presser foot, the stitch interval cannot be changed unless the presser foot is changed to another with a different size. This problem can be coped with by providing a plurality of differently sized presser feet and selecting a desired one. However, changing the presser foot is extremely troublesome for the operator, and providing a plurality of presser feet results in cost disadvantage. Furthermore, the number of presser feet to be provided has a definite limit. As a result, changing the stitch interval also has a definite limit, and the stitch interval cannot be changed to a desired value in many cases.

On the other hand, the sewing machine disclosed by Japanese Patent No. 2775961 comprises the projector which projects the linear sewing reference line serving as the mark to position the edge of the workpiece cloth. The sewing reference line is projected onto the sewing bed and a part of the upper surface of the workpiece cloth spaced away frontward from the needle drop point (needle hole of a needle plate). As a result, the sewing machine disclosed by Japanese Patent No. 277596 has a difficulty in forming stitches with a predetermined stitch interval being provided relative to the edge of the workpiece cloth including a curved one as in the case where a presser foot is used in the apparatus shown in FIG. 20.

SUMMARY

Therefore, an object of the disclosure is to provide a workpiece cloth positioning guide device for a sewing machine, which projects onto an upper side of the workpiece cloth a sewing reference mark including a circle with a center corresponding with a needle drop point and positioning the workpiece cloth relative to the sewing reference mark, thereby being capable of forming stitches readily and reliably so that the stitches are spaced away by a predetermined stitch interval from the edge of each of workpiece cloths having various shapes including a curved one or from the stitches previously formed on the workpiece cloth, the workpiece cloth positioning guide device being capable of varying the stitch interval to a desired interval and readily carrying out the variation of the stitch interval.

The present disclosure provides a workpiece cloth positioning guide device for a sewing machine which includes a sewing bed on which workpiece cloth to be sewn is placed, a light source and a sewing needle. The device comprises a projector which projects a sewing reference mark onto an upper side of the workpiece cloth placed on the sewing bed of the sewing machine, wherein the projector includes a telescopic cylindrical body having an upper end provided with the light source and a lower end, a transmission part provided in a lengthwise middle portion of the cylindrical body and formed with a mark forming pattern for forming the sewing reference mark, a projector lens provided in the lower end of the cylindrical body, and a projector lens elevating unit which raises and lowers the projector lens, the projector irradiates the workpiece cloth with light emitted by the light source onto a needle drop reference point of the sewing needle of the sewing machine from obliquely above so that the sewing reference mark is projected, the sewing mark including a circle display portion and a center display portion that is a center of the circle display portion and corresponds with a needle drop reference point, both portions being formed on the upper side of the workpiece cloth, the circle display portion of the sewing reference mark guides positioning the workpiece cloth in sewing, and the center display portion guides the needle drop reference point of the sewing needle of the sewing machine, and the projector includes a mark size setting unit which sets a size of the circle of the sewing reference mark to a desired size, the mark size setting unit changes the size of the sewing reference mark by raising or lowering the projector lens by the projector lens elevating unit.

According to the above-described construction, light emitted by the light source is illuminated onto the needle drop reference point of the sewing needle of the sewing machine from obliquely above. As a result, the sewing reference mark including a circle having a center thereof at the needle drop reference point is projected onto the upper side of the workpiece cloth. Consequently, the workpiece cloth is positioned so as to be adjacent to the edge of the workpiece cloth or the previously formed stitches (previously formed stitches). The workpiece cloth is fed while being maintained in the positioned state, whereupon stitches are formed with a predetermined stitch interval (a radius of the foregoing circle) relative to the edge of the workpiece cloth or the previously formed stitches.

In addition, the projector includes a mark size setting unit which sets a size of the circle of the sewing reference mark to a desired size. Accordingly, the stitch interval can be changed to a desired value.

BRIEF DESCRIPTION OF THE DRAWINGS

Other objects, features and advantages of the present disclosure will become clear upon reviewing the following description of the illustrative examples with reference to the accompanying drawings, in which.

DETAILED DESCRIPTION OF THE DISCLOSURE

Figure 1:
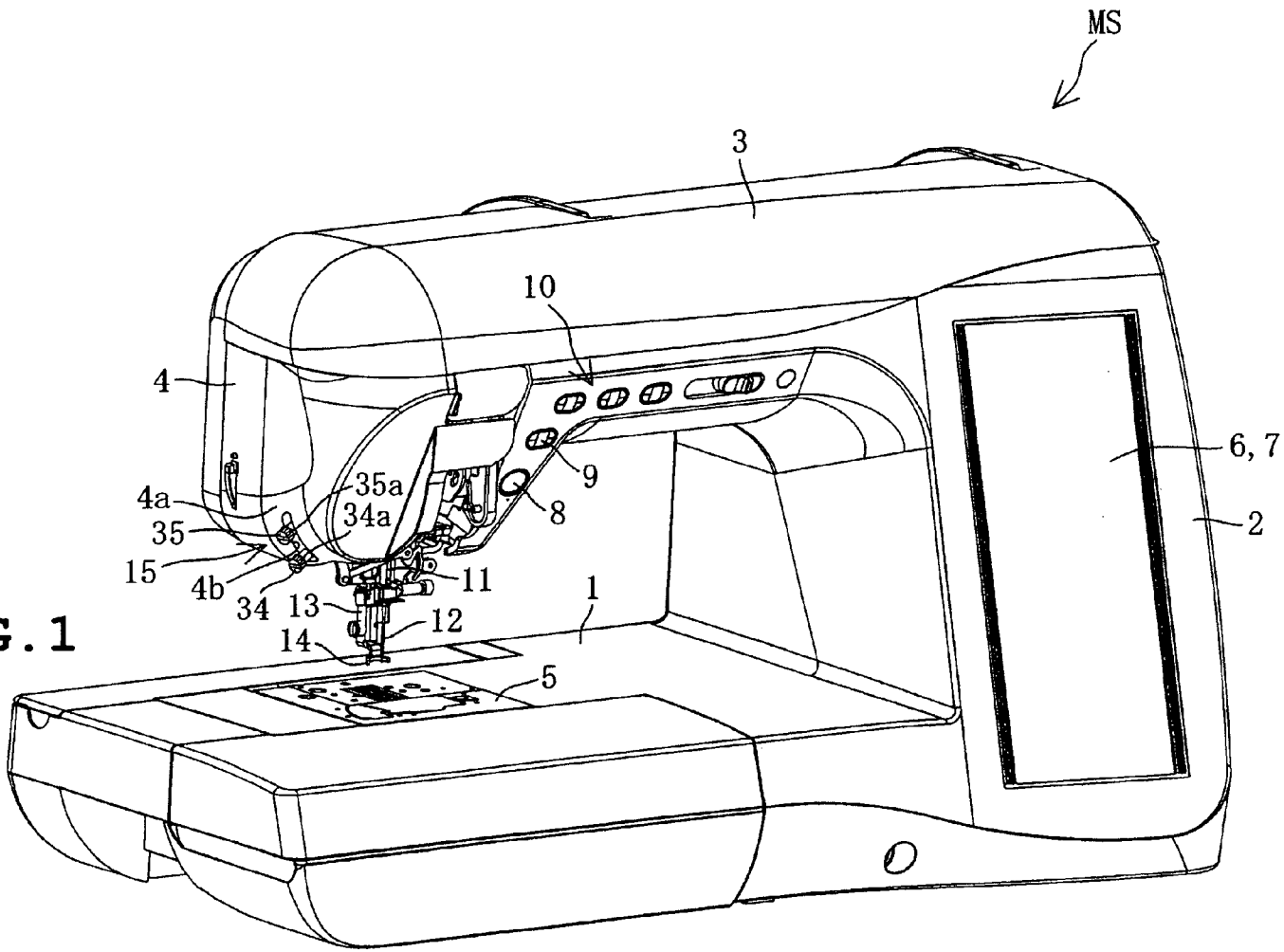
FIG. 1 is a perspective view of a sewing machine in accordance with one illustrative example of the disclosure.
Figure 2:
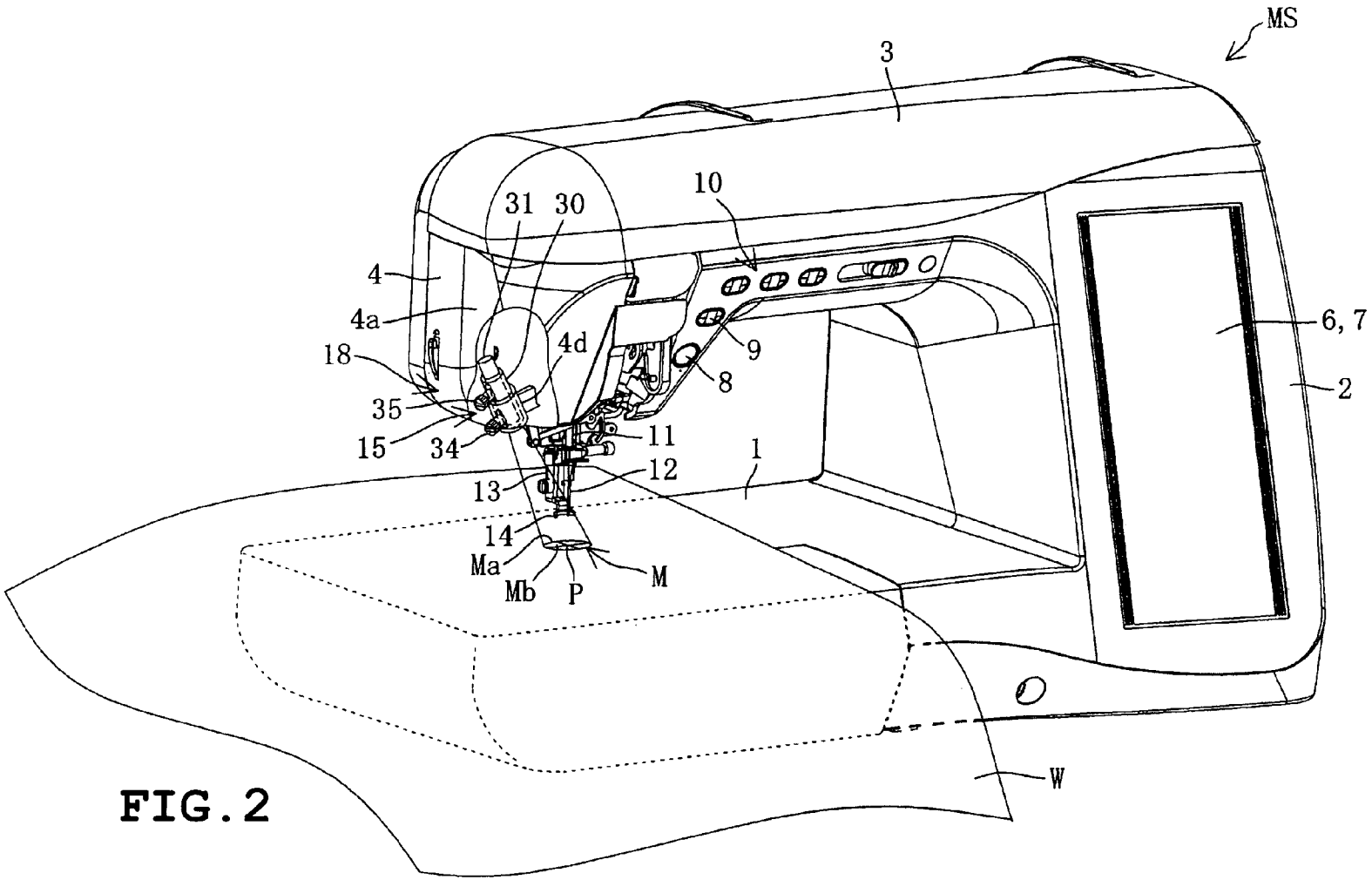
FIG. 2 is another perspective view of the sewing machine which is set with a workpiece cloth and from which a part of the head is eliminated.

A first embodiment of the present disclosure will be described with reference to FIGS. 1 to 12. Referring to FIGS. 1 and 2, a sewing machine MS includes a sewing bed 1, a sewing pillar 2 extending upward from a right part of the bed 1, a sewing arm 3 extending leftward from an upper end of the pillar 2 and a sewing head 4 mounted on a left end of the arm 3. The bed 1 has an upper side on which a needle plate 5 is mounted. The pillar 2 has a front on which a liquid crystal display 6 capable of performing color display is provided. The liquid crystal display 6 has a front on which a transparent touch panel 7 is provided. Various operation switches 10 including a start switch 8 and a projecting switch 9 are provided on fronts of the arm 3 and head 4.

Figure 3:
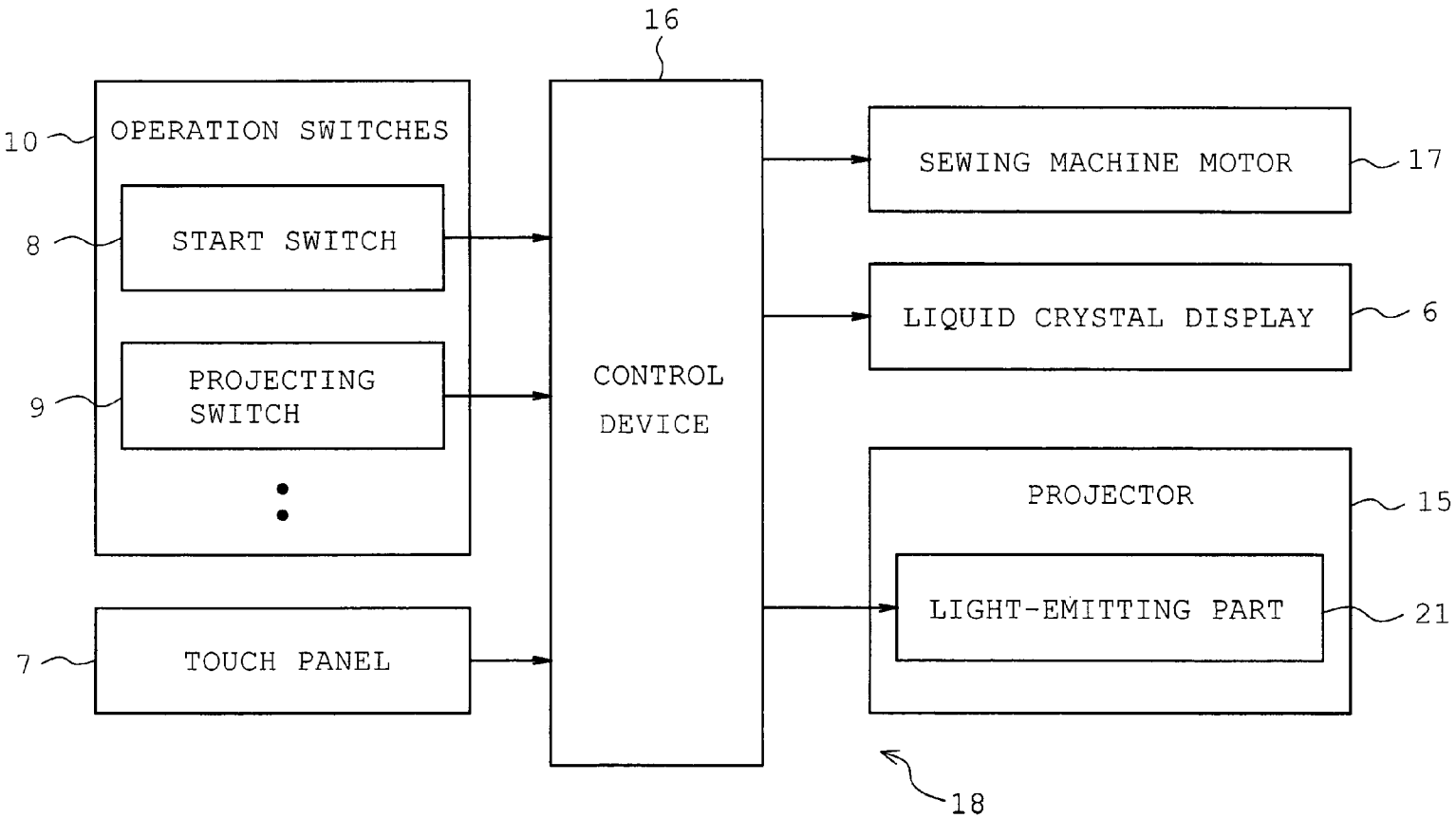
FIG. 3 is a block diagram showing an electrical arrangement of the control system of the sewing machine.

A sewing machine main shaft (not shown) is provided in the arm 3 so as to be driven by a sewing machine motor 17 (see FIG. 3). A needle bar 11 is attached to the head 4 so as to be swingable vertically. The needle bar 11 is driven by the main shaft. The needle bar 11 has a lower end on which a sewing needle 12 is mounted. A presser bar 13 driven by the main shaft is attached to the head 4 so as to be located in the rear of the needle bar 11 and so as to be raised and lowered. The presser bar 13 has a lower end on which a presser foot 14 is mounted. The presser foot 14 has a lower end serving as a cloth-pressing part formed into the shape of a half ring made by cutting out a front half of a ring. The head 4 includes a front left part to which a projector 15 is attached. A major part of the projector 15 is housed in a cover 4*a* of the head 4. The projector 15 includes a pair of adjusting screws 34 and 35 having respective knobs 34*a* and 35*a* which protrude outward through a slit 4*b* formed in the cover 4*a* as shown in FIG. 1. A thread take-up and a thread tension regulator are also attached to the head 4 although neither is shown.

Referring to FIG. 3, the sewing machine M is provided with a control device 16 which is responsive to signals delivered thereto from operation switches 10 including a start switch 8 and a projecting switch 9, and a touch panel 7, thereby controlling the sewing machine motor 17, the liquid crystal display 6 and a light-emitting part of the projector 15. A workpiece cloth positioning guide device 18 projects a sewing reference mark M on an upper side of the workpiece cloth W placed on the bed 1 to guide the workpiece cloth W in the case where the workpiece cloth W is to be positioned in sewing. The workpiece cloth positioning guide device 18 comprises the projector 15.

The workpiece cloth positioning guide device 18 will now be described in detail. The projector 15 irradiates a needle drop reference point P of the sewing needle 12 with light emitted from obliquely above in the front and left thereby to project a sewing reference mark M on the upper side of the workpiece cloth W placed on the bed 1 as shown in FIGS. 2 to 6. The sewing reference mark M is comprised of a circle Ma having a center thereof at the needle drop point P and a cross Mb having an intersection at the needle drop point P. The projector 15 includes a cylindrical body 20, a light emitting part 21, a collection mirror 22, an illuminating optical lens group 23, an optical penetration part 24, projector lens 25 and first and second position adjusting mechanisms 26 and 27.

The cylindrical body 20 is disposed in such an attitude as to be inclined rearwardly and leftwardly downward so that the needle drop point P is located on a centerline of the cylindrical body 20. The cylindrical body 20 includes an outer cylinder 30 and an inner cylinder 31 which is fitted in the outer cylinder 30 from an upper part of the outer cylinder 30 so as to be slidable, whereupon the cylindrical body 20 is telescopic. More specifically, the outer cylinder 30 is moved lengthwise with respect to a casing of the head 4 by the first position adjusting mechanism 26 thereby to be fixed so that, the position of the outer cylinder 30 is adjustable. The inner cylinder 31 is moved lengthwise relative to the outer cylinder 30 by the second positioning mechanism 27 thereby to be fixed so that the position of the inner cylinder 31 is adjustable.

The inner cylinder 31 has an upper end on which a light emitting part 21 serving as a light source and the collection mirror 22 are provided. The light emitting part 21 is connected to the control device 16 by an electric code 21*a*. The inner cylinder 31 has a lengthwise middle on which the illuminating optical lens group 23 is provided. The inner cylinder 31 has a lower end (the lengthwise middle of the cylindrical body 20) on which the optical penetration part 24 is provided. The outer cylinder 30 (cylindrical body 20) has a lower end on which the projector lens 25 is provided. The light emitting part 21 comprises a full-color light-emitting diode (LED) which can emit light with a plurality of colors (for example, three colors of red, blue and white). Light with one of these colors may be selected.

Figure 6:
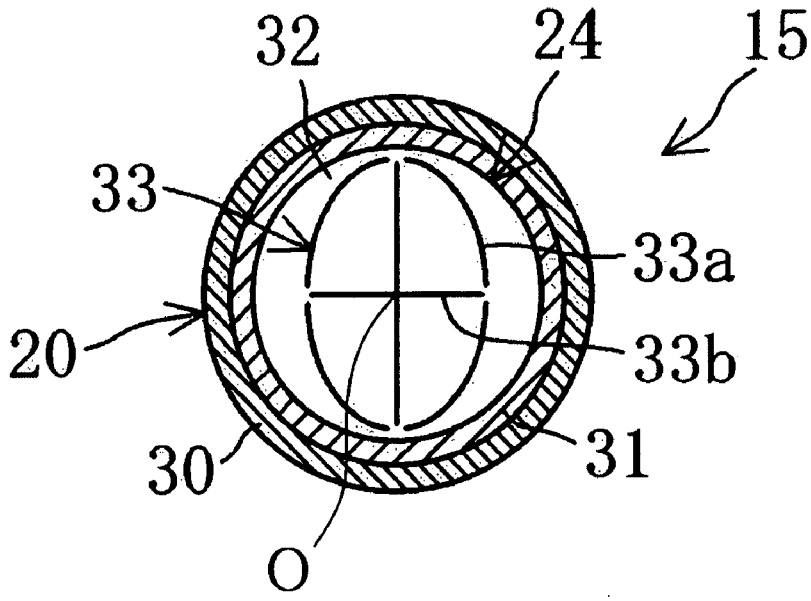
FIG. 6 is a view taken along line VI-VI in FIG. 5.

The optical penetration part 24 has a generally disc-shaped masking member 32 which has an outer circumferential part which is secured to an inner circumferential face of the inner cylinder 31 so as to intersect with the centerline of the cylindrical body 20 as shown in FIG. 6. The masking member 32 is formed with a mark forming pattern 33 including slits for forming the sewing reference mark P. The mark forming pattern 33 has a configuration which is set so that the circle Ma of the sewing reference mark M on which light is irradiated from obliquely above relative to the workpiece cloth W placed on the bed 1 has a predetermined circularity.

The optical penetration part 24 is disposed so as to be perpendicular to the centerline of the cylindrical body 20. The mark forming pattern 33 includes a circle forming pattern 33*a* and a cross forming pattern 33*b*. The circle forming pattern 33*a* is formed into a generally elliptic shape. The cross forming pattern 33*b* is formed so as to correspond substantially with long and short axes of the elliptic shape. The short axis of the cross forming pattern 33*b* has a direction corresponding with a direction of a straight line connecting between the center O of the optical penetration part 24 and the reference needle drop point P. The mark forming pattern, which comprises slits, is formed so as to be discontinuous at four circumferential portions of the circle forming pattern 33*a* so that the masking member 32 is prevented from being cut.

Figure 4:
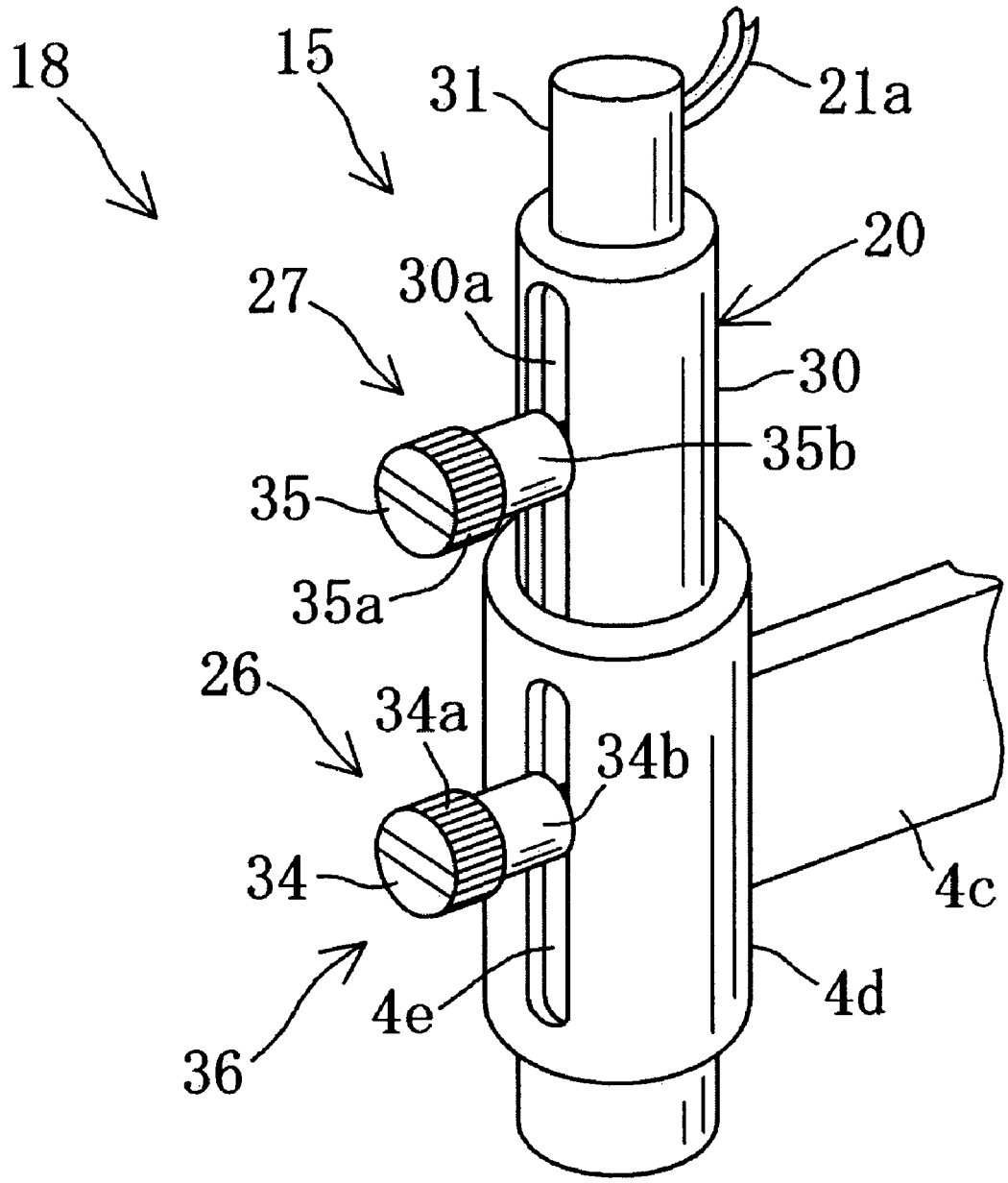
FIG. 4 is a perspective view of a projector of the sewing machine.
Figure 5:
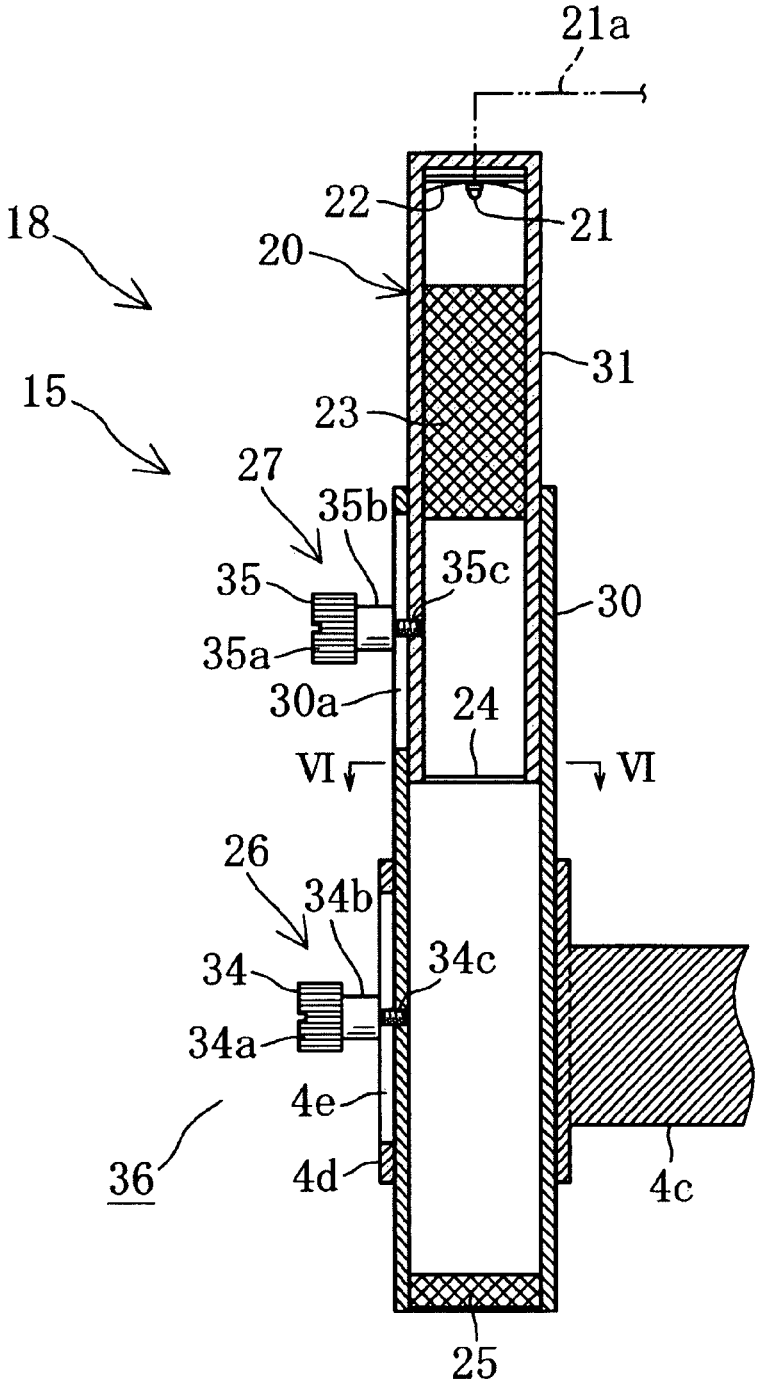
FIG. 5 is a longitudinally sectional view of the projector.

Referring now to FIGS. 2, 4 and 5, the first position adjusting mechanism 26 has a holder 4*d* coupled to a casing 4*c* of the head 4 so that the outer cylinder 30 is slidably fitted with the holder 4*d*, a slit 4*e* which is formed in the holder 4*d* so as to extend lengthwise with respect to the cylindrical body 20, and an adjusting screw 34. The adjusting screw 34 has a knob 34*a*, a stepped part 34*b*, and a thread part 34*c*. The thread part 34*c* is inserted through the slit 4*e* to be threadingly engaged with the outer cylinder 30. When the adjusting screw 34 is tightened up, the holder 4*d* is held between the stepped part 34*b* and the outer cylinder 30, whereby the outer cylinder 30 is fixed to the holder 4*d*. When the adjusting screw 34 is loosened, the outer cylinder 30 is released from a fixed state so as to be allowed to be raised and lowered.

Referring further to FIGS. 2, 4 and 5, the second position adjusting mechanism 27 has a slit 30*a* formed in an upper part of the outer cylinder 30 pivotally fitted in the inner cylinder 31, and an adjusting screw 35 having a knob 35*a*, a stepped part 35*b* and a thread part 35*c*. The thread part 35*c* is inserted through the slit 30*a* to be threadingly engaged with the inner cylinder 31. When the adjusting screw 35 is tightened up, the outer cylinder 30 is held between the stepped part 35*b* and the inner cylinder 31, whereby the inner cylinder 31 is fixed to the outer cylinder 30. When the adjusting screw 35 is loosened, the inner cylinder 31 is released from the fixed state to be allowed to be raised and lowered. The first position adjusting mechanism 26 serves as a projector lens elevating unit raising and lowering the projector lens 25.

Figure 7:
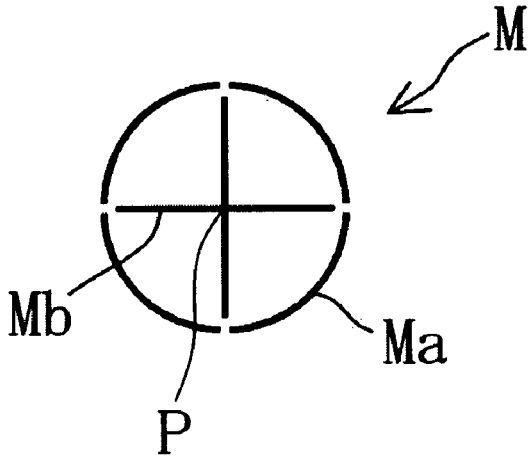
FIG. 7 is a plan view of a sewing reference mark.

Light emitted from the light emitting part 21 (see FIG. 5) is irradiated through the illumination optical lens group 23 onto the optical penetration part 24. The light further passes through the mark forming pattern 33 comprising the slit and the projector lens 25, being irradiated onto the upper side of the workpiece cloth W. As a result, an image of the sewing reference mark M is projected onto the upper side of the workpiece cloth W and composed of the circle Ma having the center corresponding with the needle drop reference point P and a cross Mb with the short and long axes intersecting at the needle drop reference point P as shown in FIGS. 2 and 7.

In the embodiment, the sewing machine is provided with a mark size setting mechanism 36 which changes the size of the sewing reference mark M (composed of the circle Ma and the cross Mb) to a desired size. The mark size setting mechanism 36 is constructed so as to be capable of changing the size of the sewing reference mark M by raising and/or lowering the projector lens 25 together with the outer cylinder 30 by the first position adjusting mechanism 26. More specifically, when the projector lens 25 is raised by the first position adjusting mechanism 26, the size of the sewing reference mark M is increased. When the projector lens 25 is lowered, the size of the sewing reference mark M is reduced. Thus, the size of the sewing reference mark M is changed to a desired size according to raising and lowering of the projector lens 25. Furthermore, the optical permeation part 24 is raised and/or lowered relative to the projector lens 25 by the second position adjusting mechanism 27 so that the focus of the projector lens 24 is adjusted. As a result, a clear sewing reference mark M can be projected on the upper side of the workpiece cloth W.

Figure 8:
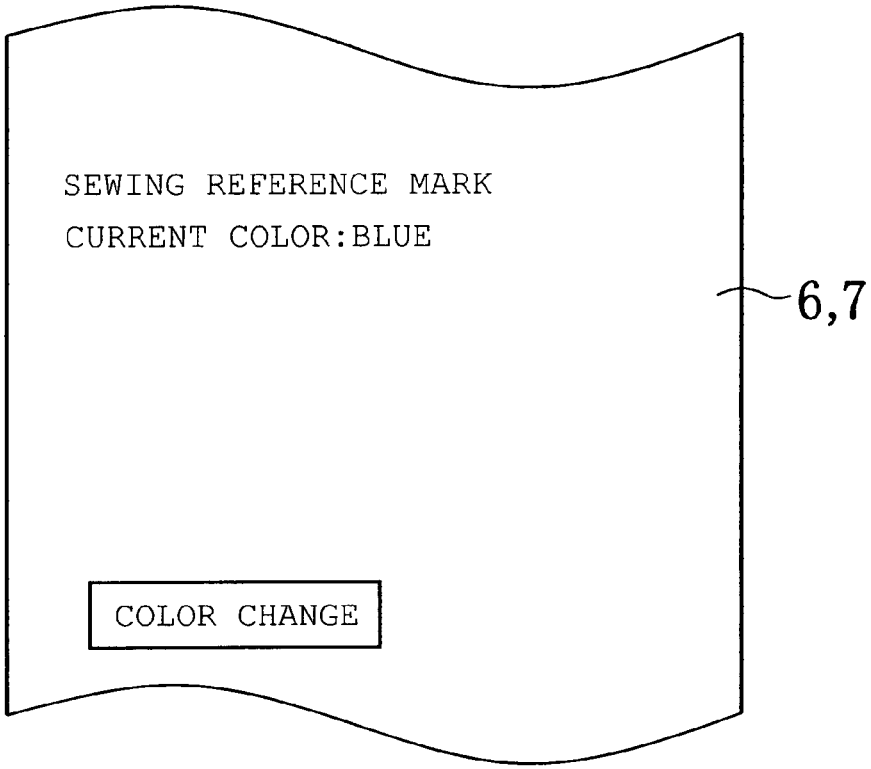
FIG. 8 shows a display screen displaying the contents of the sewing reference mark.
Figure 9:
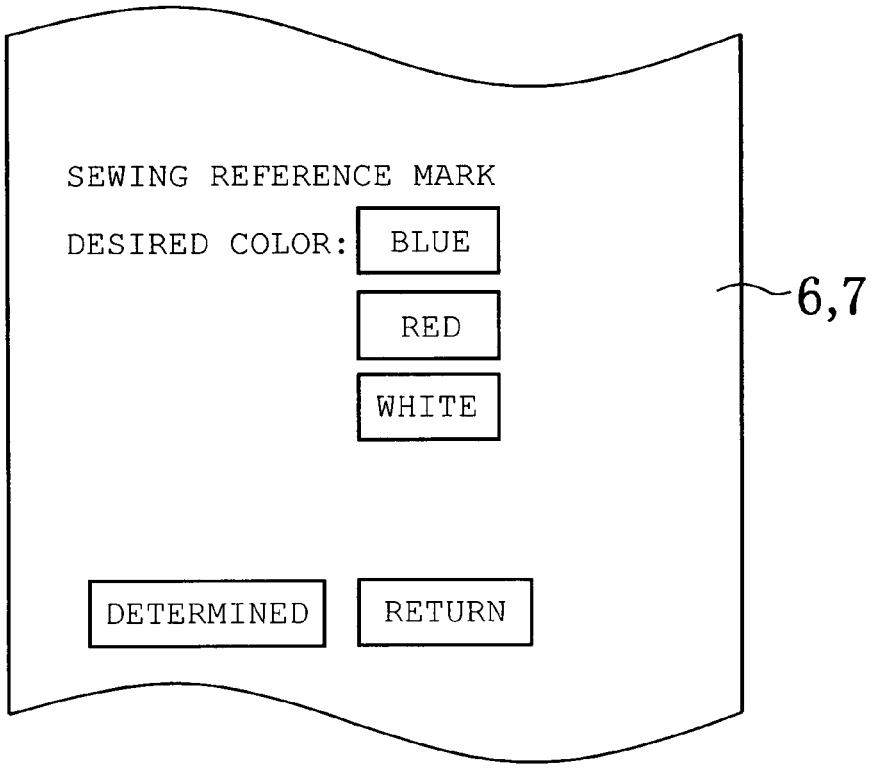
FIG. 9 shows another display screen displaying change of the color of the mark.

The control device 16 executes a turn-on control and a turn-off control for the light emitting part 21 alternately every time the projecting switch 9 is turned on and off respectively, so that, for example, the color of the currently set and projected sewing reference mark M is displayed on the liquid crystal display 6 while the light emitting part 21 is turned on, as shown in FIG. 8. When the color of the sewing reference mark M is desired to be changed, the operator touches an indication of "color change" on the touch panel 7. The control device 16 then controls the liquid crystal display 6 so that a mark color change screen as shown in FIG. 9 is displayed on the liquid crystal display 6. Changeable colors, for example, "blue," "red" and "white" are displayed on the mark color change screen. When the operator touches a desired color ("blue," "red" or "white") on the touch panel 7 to input the desired color and further touches an indication of "determined," the control device 16 turns on the light emitting part 21 so that light in the input color is emitted. The control device 16 and the touch panel 7 serve as a mark color changing unit which changes the color of the sewing reference mark M to be projected by the projector 15 to any one of a plurality of colors. Alternatively, while the light emitting part 21 is turned off, the control device 16 may control a storage so that data of the color of light emitted before turn-off of the light emitting part 21 is stored on the storage. When the projecting switch 9 is subsequently turned on, the light in the color the data of which is stored on the storage may be emitted from the light emitting part 21.

Figure 10:
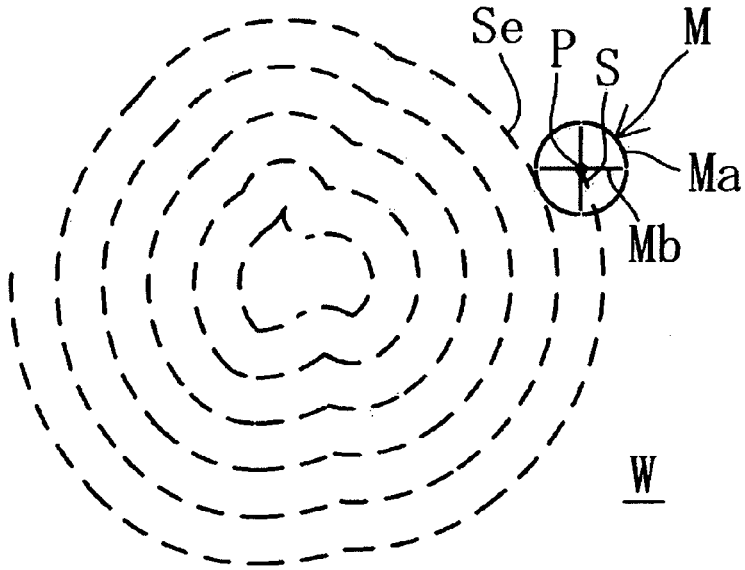
FIG. 10 is a top view of a part of the workpiece cloth in the case where the sewing reference mark is used in sewing.
Figure 11:
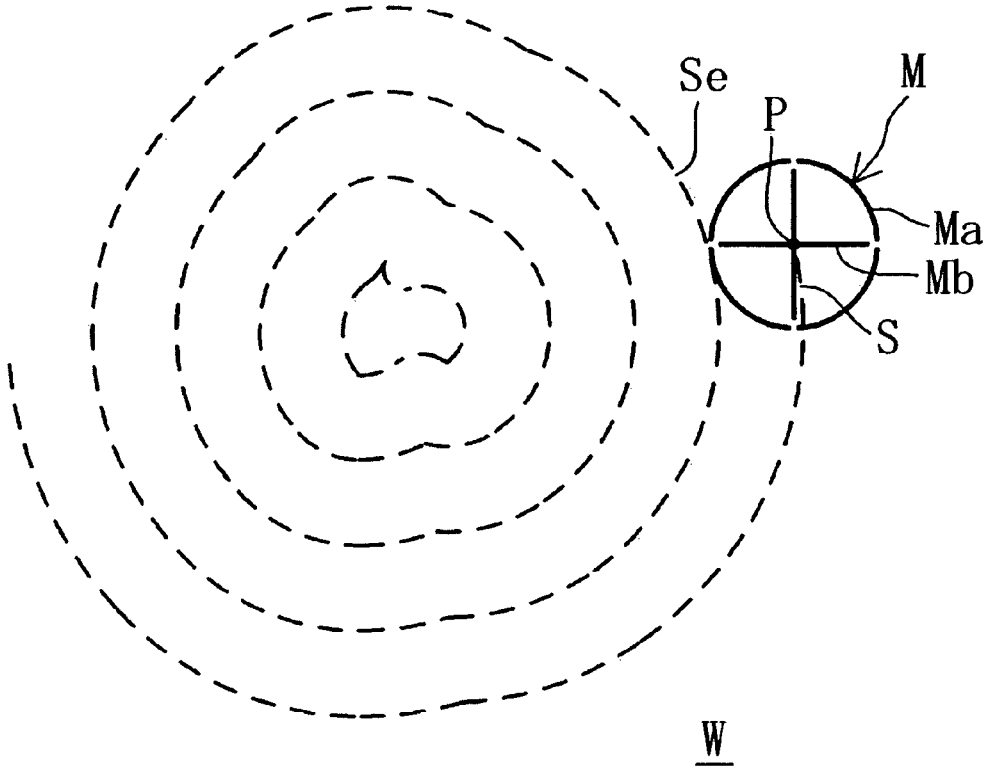
FIG. 11 is a top view of the part of the workpiece cloth in the case where the sewing reference mark is used in sewing.
Figure 12:
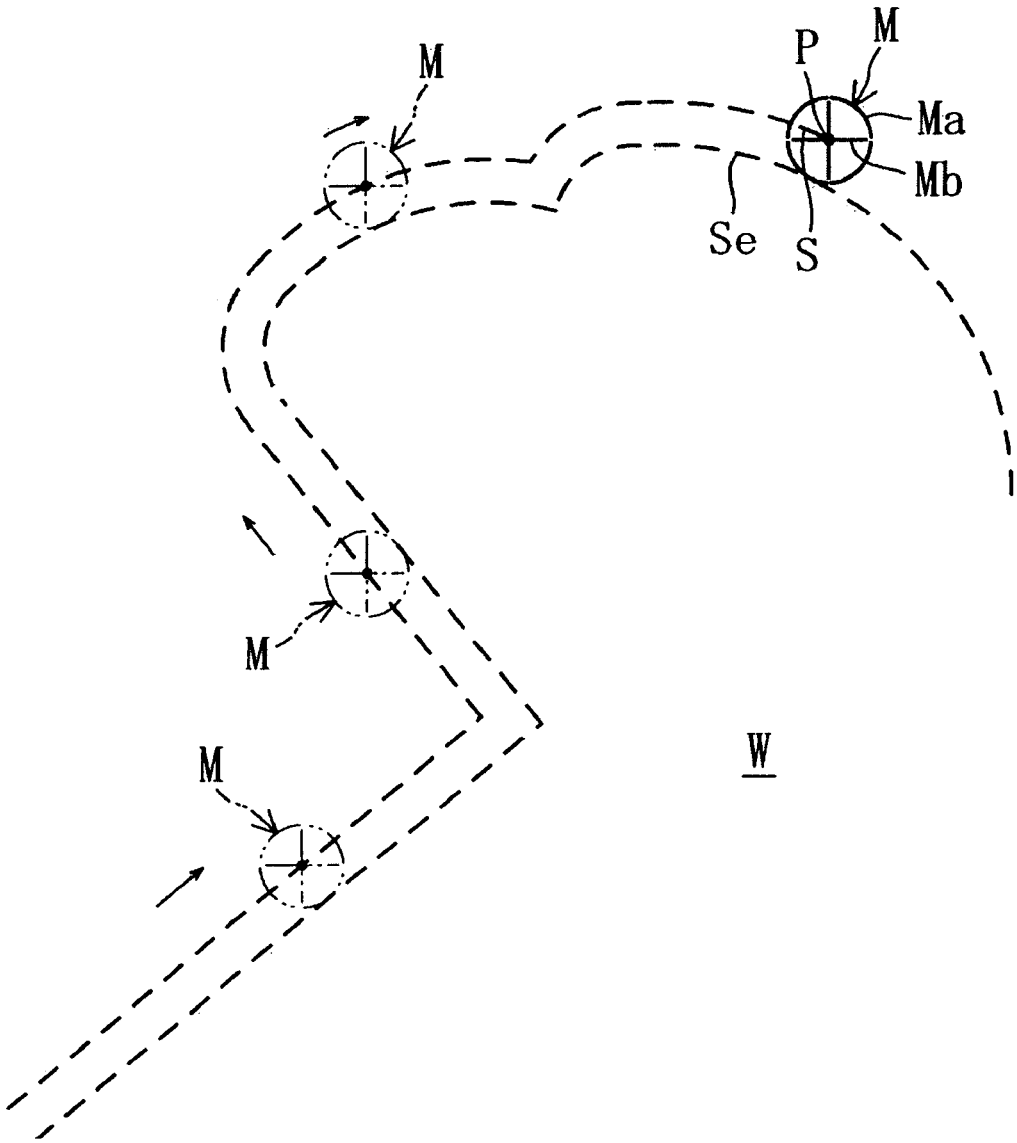
FIG. 12 is a top view of the part of the workpiece cloth in the case where the sewing reference mark is used in sewing.

The operation and advantages of the workpiece cloth positioning guide device will be described. Light is irradiated on the reference needle drop point P from obliquely above so that the sewing reference mark M is projected onto the upper side of the workpiece W. The projected mark M includes the circle Ma having a center corresponding with the needle drop point P. Accordingly, as shown in FIGS. 10 to 12, the operator can reliably position the workpiece cloth W in sewing so that the outer circumference of the circle Ma of the sewing reference mark M is adjacent to the stitches Se previously formed on the workpiece cloth W (preformed stitches Se). Accordingly, when the workpiece cloth W is manually fed so that the workpiece cloth W is maintained in the positioned state, the stitches S can be formed readily and reliably with a predetermined stitch interval (a radius of the circle Ma) from the edge of the workpiece cloth W of various shapes including a curved shape.

The projector 15 irradiates the needle drop reference point P of the sewing needle 12 with the light emitted from obliquely above in the front and left thereby to project the sewing reference mark M on the upper side of the workpiece cloth W. Since the cloth-pressing part of the presser foot 14 is formed into the shape of half ring by cutting out the front half of the ring, at least a front half of the sewing reference mark M is projected onto the upper side of the workpiece cloth W. Accordingly, since the operator can view the front half of the sewing reference mark M without being interrupted by the presser foot 14, the workpiece cloth W can reliably be positioned in sewing so that the outer circumference of the circle Ma of the sewing reference mark M is adjacent to the stitches Se previously formed on the workpiece cloth W or the edge of the workpiece cloth W. Furthermore, the workpiece cloth W can reliably be fed so as to be maintained in the positioned state.

Consequently, while using the sewing machine MS of the embodiment, the operator can easily carry out quilting in such a manner that a plurality of stitches are formed on the workpiece cloth W with a predetermined stitch interval outside the stitches of a desired figure so that a wavelike pattern is formed. Accordingly, a piece of work with a good-looking pattern can be formed.

In the foregoing embodiment, the mark size setting mechanism 36 changes the size of the circle Ma of the sewing reference mark M to a desired size. Accordingly, the stitch interval can be changed to a desired one. For example, as shown in FIG. 10, when a pattern with a narrow or small stitch interval is desired, the size of the circle Ma is reduced. When a pattern with a wide or large stitch interval is desired, the size of the circle Ma is increased as shown in FIG. 11.

The projector 15 includes the telescopic cylindrical body 20 having the upper end provided with the light emitting part 21, the transmission part provided in the lengthwise middle portion of the cylindrical body 20 and formed with the mark forming pattern for forming the sewing reference mark M, and the projector lens 25 provided in the lower end of the cylindrical body 20. Consequently, the sewing reference mark M can reliably be projected onto the upper side of the workpiece cloth W.

Furthermore, the first position adjusting mechanism 26 is provided as the projector lens raising and lowering unit which raises and lowers the projector lens 25. The mark size setting mechanism 36 is constructed so as to change the size of the sewing reference mark by raising and/or lowering the projector lens 25 by the first position adjusting mechanism 26. Consequently, the size of the sewing reference mark M can easily be changed.

The configuration of the mark forming pattern 33 is set so that the circle Ma of the sewing reference mark M which is projected onto the workpiece cloth W from obliquely above has the predetermined circularity. Accordingly, the sewing reference mark M including the circle Ma having the predetermined circularity can reliably be projected onto the upper side of the workpiece cloth W. Furthermore, the projector 15 is installed at the position where the projector 15 does not interfere with mechanism components incorporated in the head 4. The circle of the sewing reference mark M to be irradiated has the predetermined circularity even when the image of the sewing reference mark M is irradiated from obliquely above relative to the workpiece cloth W. Consequently, the distance (namely, the radius of the circle) between the reference needle drop point P and the edge of the workpiece cloth W or previously formed stitches can be rendered accurately constant over the whole circumference.

The sewing reference mark M includes the image of the cross Mb having the short and long axes intersecting on the reference needle drop point P. Accordingly, the image of the reference needle drop point P can be displayed on the upper side of the workpiece cloth W and viewed clearly and easily. Furthermore, since the color of the sewing reference mark M projected by the projector 15 can be changed to one of a plurality of colors, the sewing reference mark M having the color differing from the color of the workpiece cloth W can be projected onto the upper side of the workpiece cloth W. As a result, the visibility of the sewing reference mark M can be improved such that the sewing reference mark M is easily-viewable, that is, the workpiece cloth W can be applied to various colors.

Figure 13:
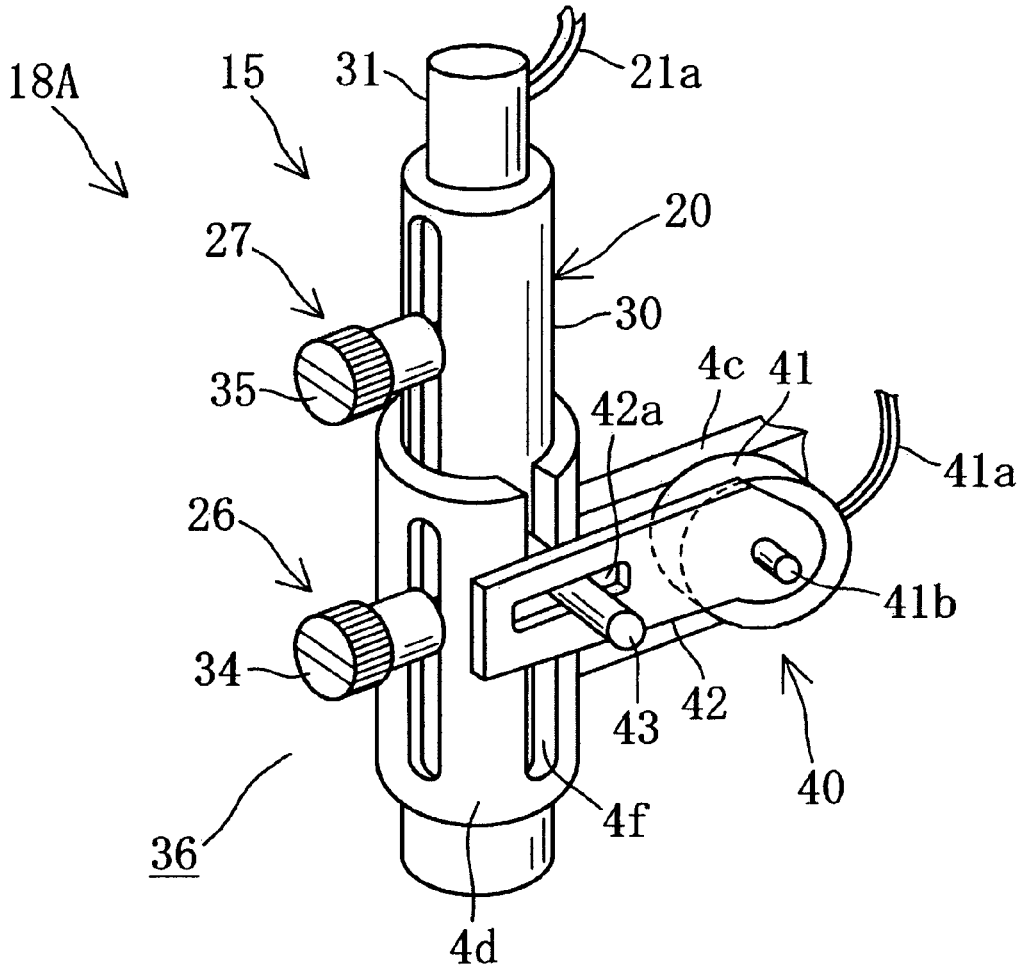
FIG. 13 is a perspective view of the projector employed in the sewing machine of a second illustrative example in accordance with the present disclosure.
Figure 14:
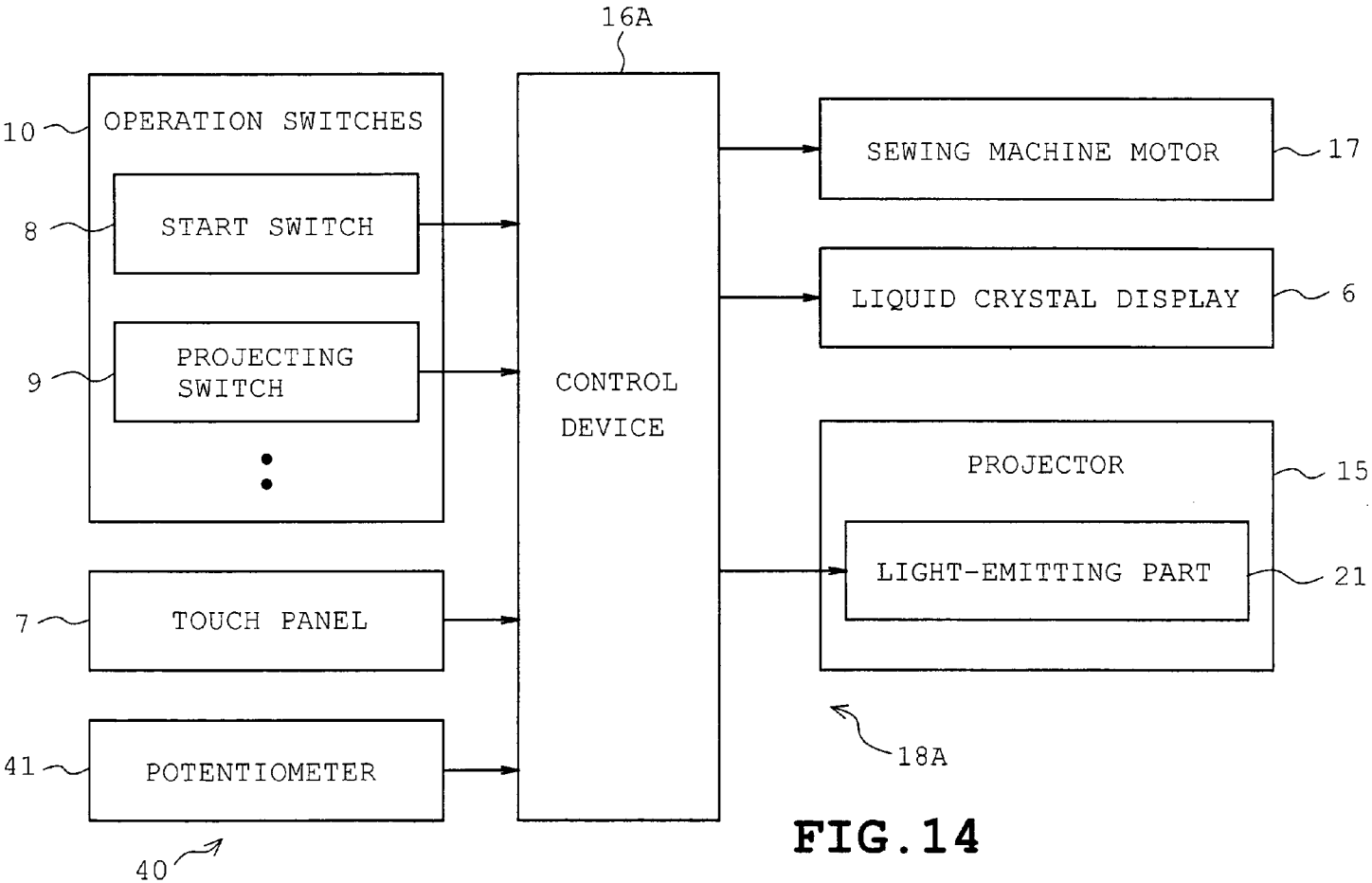
FIG. 14 is a block diagram showing an electrical arrangement of the control system of the sewing machine.
Figure 15:
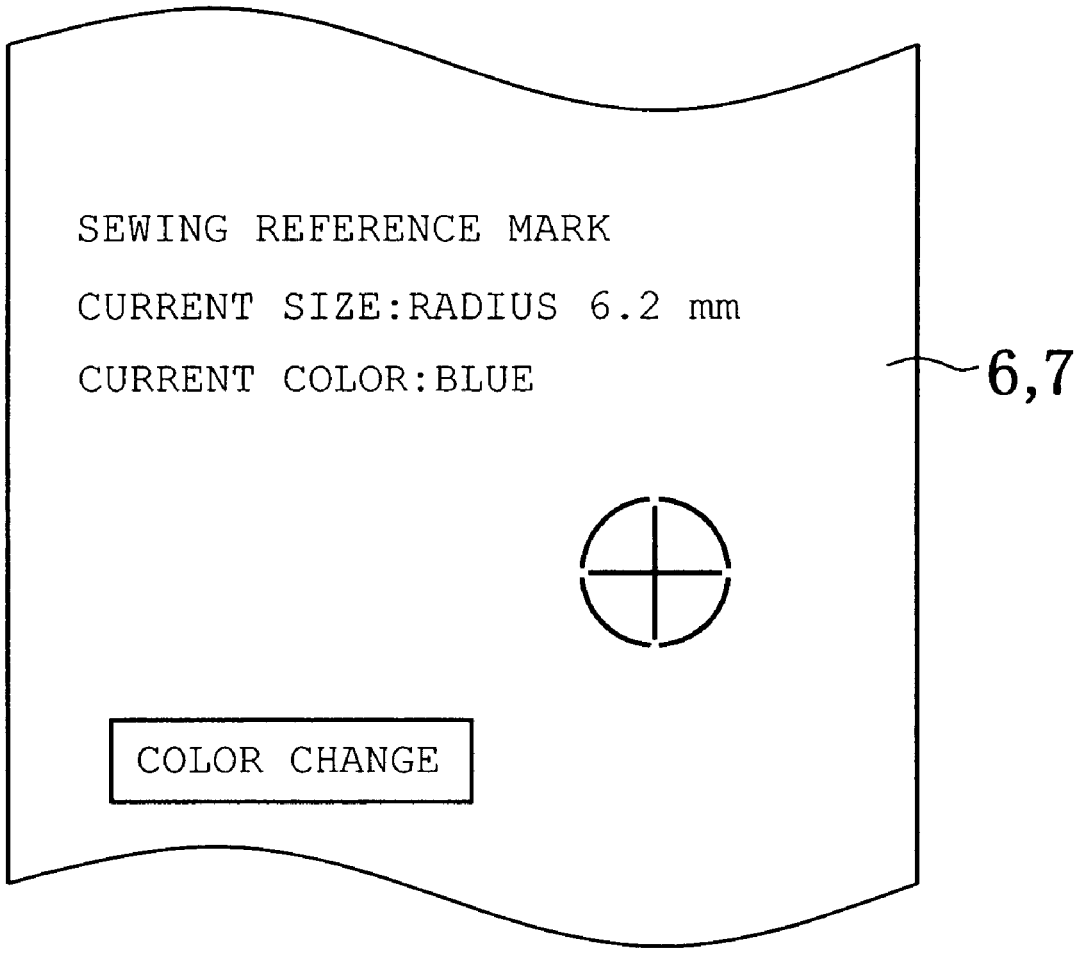
FIG. 15 shows a display screen displaying the contents of the sewing reference mark.

FIGS. 13 to 15 illustrate a second embodiment. The following will describe only the difference of the second embodiment from the first embodiment. The workpiece cloth positioning guide device 18A includes the projector 15, the control device 16A, the projecting switch 9, the touch panel 7 and a raised or lowered position detecting mechanism 40, as shown in FIGS. 13 and 14. The description of the above-described components other than the control device 16A and the raised or lowered position detecting mechanism 40 is eliminated. More specifically, each of the projector 15, the projecting switch 9, the touch panel 7 and the sewing machine MS has the same construction as that in the first embodiment. Accordingly, these components are labeled by the same reference symbols as those in the first embodiment and description of these components will be eliminated. However, the holder 4*d* with which the outer cylinder 30 of the projector 15 is slidably fitted is formed with a slit 4*f* extending lengthwise with respect to the cylindrical body 20.

The raised or lowered position detecting mechanism 40 is provided for detecting a raised or lowered position of the outer cylinder 30 of the projector 15 and comprises a potentiometer 41, a swing arm 42, a connecting shaft member 43. The potentiometer 41 is fixed to the casing 4*c* to which the holder 4*d* is also fixed. The potentiometer 41 is connected to the control device 16A by an electric code 41*a*. The potentiometer 41 includes an input shaft 41*b* to which a proximal end of the swing arm 42 is fixed. The swing arm 42 has an elongated hole 42*a* formed in a distal end side thereof. The connecting shaft member 43 is fixed to the outer cylinder 30 and inserted through the slit 4*f* to be engaged with the elongated hole 42*a*.

The control device 16A controls the liquid crystal display 6 so that the color of the currently set and projected sewing reference mark M is displayed on the liquid crystal display 6 in the same manner as the control device 16 of the first embodiment, as shown in FIG. 15. When the operator touches the indication of "color change" on the touch panel 7, a mark color changing screen as shown in FIG. 9 is displayed, whereupon the mark color can be changed, also in the same manner as the control device 16 of the first embodiment.

Furthermore, the control device 16A controls the liquid crystal display 6 so that the size of the currently set and projected sewing reference mark M is displayed on the liquid crystal display 6, as shown in FIG. 15. In this case, the control device 16A computes a radius of the sewing reference mark M based on a signal supplied from the potentiometer 41, controlling the liquid crystal display 6 so that the numeric value of the obtained radius and the sewing reference mark M with the currently set and displayed size, shape and color. The liquid crystal display 6 and the control device 16A serve as a mark size display unit which displays the size of the sewing reference mark M set by the mark size setting mechanism 36.

According to the workpiece cloth positioning guide device 18A of the second embodiment, the liquid crystal display 6 displays the size of the sewing reference mark M set by the mark size setting mechanism 36. Accordingly, the operator can easily confirm the size of the sewing reference mark M. The other effect of the second embodiment is the same as that of the first embodiment.

Figure 16:
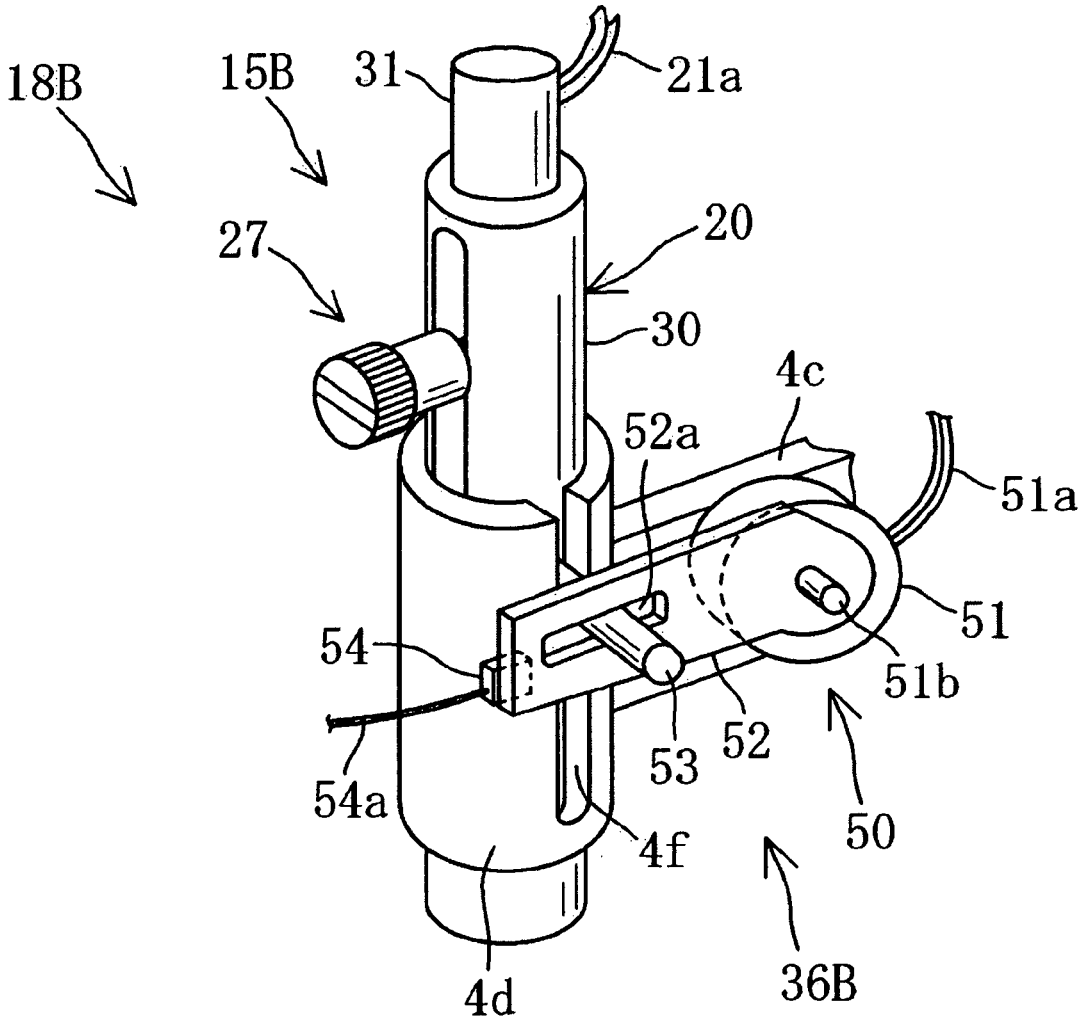
FIG. 16 is a perspective view of the projector employed in the sewing machine of a third illustrative example in accordance with the present disclosure.
Figure 17:
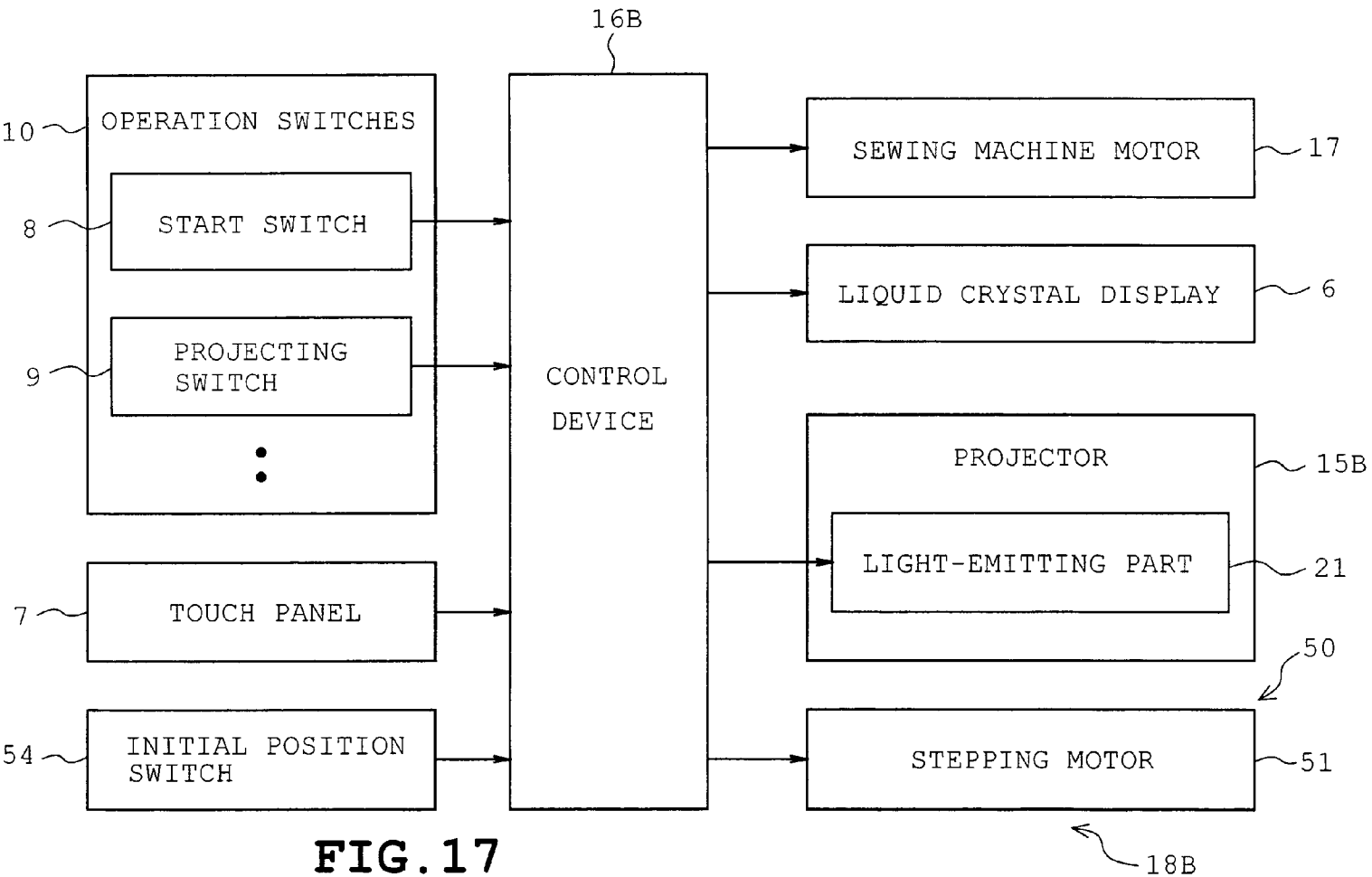
FIG. 17 is a block diagram showing an electrical arrangement of the control system of the sewing machine.
Figure 18:
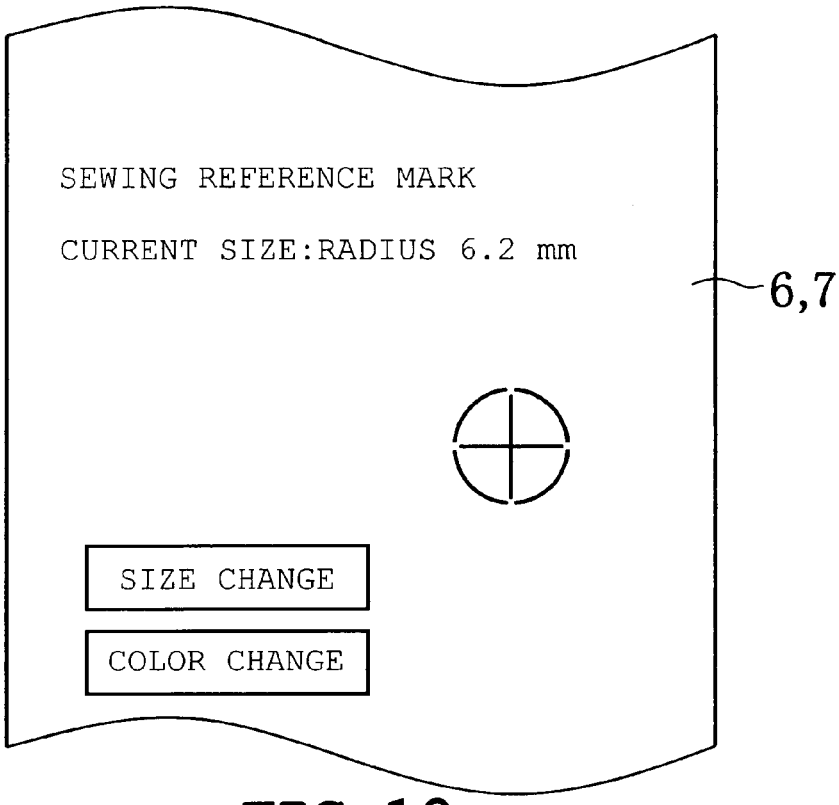
FIG. 18 shows a display screen displaying the contents of the sewing reference mark.
Figure 19:
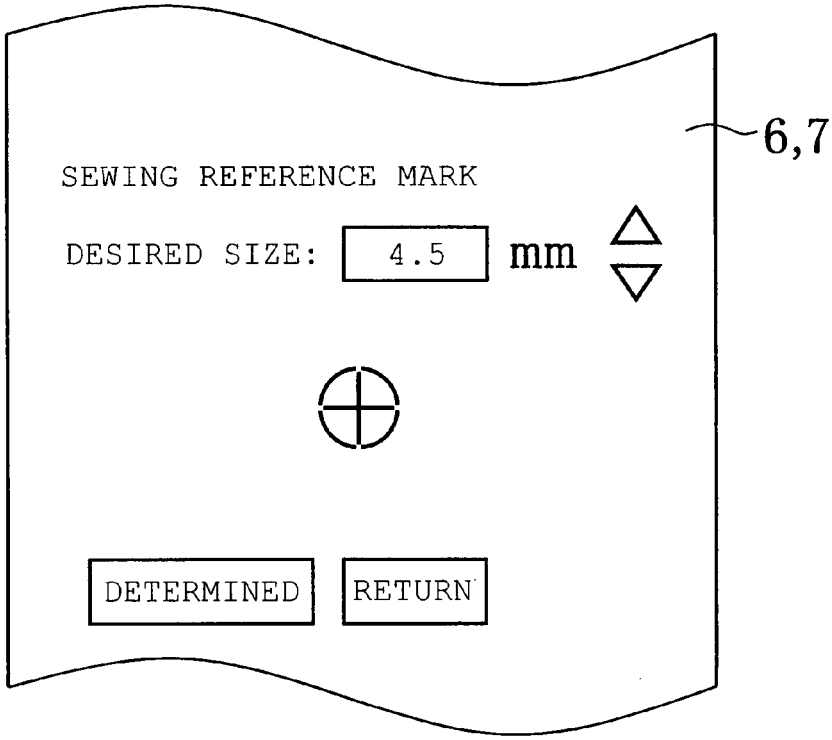
FIG. 19 shows a display screen displaying change of the size of the mark.
Figure 20:
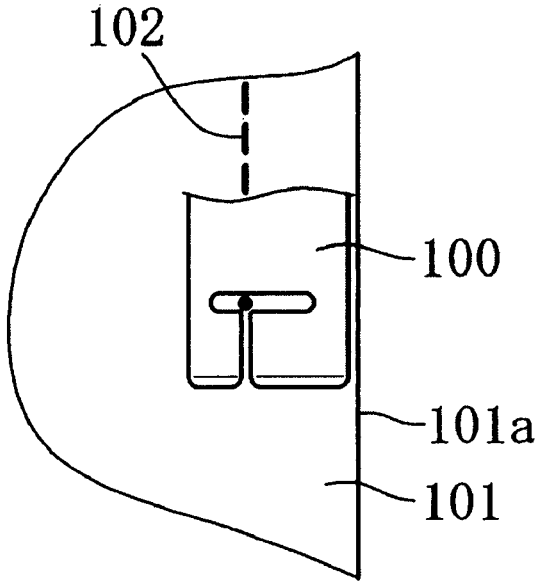
FIG.20 PRIOR ART
FIG. 20 shows a part of an upper side of workpiece cloth with a presser foot being used in sewing in a conventional sewing machine.
Figure 21:
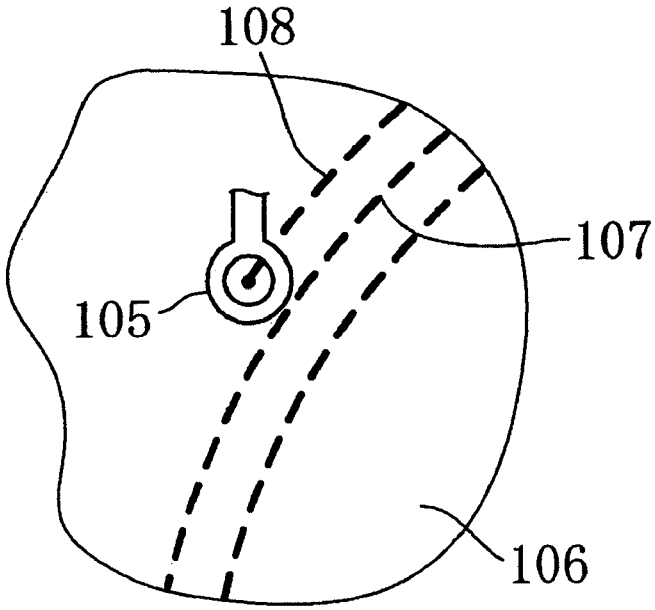
FIG.21 PRIOR ART
FIG. 21 shows a part of an upper side of workpiece cloth with a presser foot being used in sewing in another conventional sewing machine.

FIGS. 16 to 19 illustrate a third embodiment of the invention. The following will describe only the differences of the third embodiment from the first embodiment. Referring to FIGS. 16 and 17, a workpiece cloth positioning guide device 18B comprises a projector 15B, a control device 16B, a projection switch 9, a touch panel 7 and a raising and lowering drive mechanism 50. The projector 15B, control device 16B and raising and lowering drive mechanism 50 will be described later. Each of the projection switch 9, touch panel 7 and sewing machine MS has the same construction as in the first embodiment. Accordingly, the projection switch 9, touch panel 7 and sewing machine MS are labeled by the same reference symbols as those in the first embodiment and description of these components will be eliminated. However, the holder 4*d*, in which the outer cylinder 30 of the projector 15B is slidably fitted, is formed with a slit 4*f* extending lengthwise with respect to the cylinder 20.

The slit 4*c* of the first position adjusting mechanism 26 and the adjusting screw 34 are eliminated in the projector 15B of the third embodiment although provided in the workpiece cloth positioning guide device 15 of the first embodiment. The raising and lowering drive mechanism 50 is provided instead and drives the outer cylinder 30 of the projector 15 so that the outer cylinder 30 is raised and lowered. The raising and lowering drive mechanism 50 retains the outer cylinder 30 at the raised or lowered position. The raising and lowering drive mechanism 50 comprises a stepping motor 51, a swing arm 52, a connecting shaft 53 and an initial position switch 54.

The stepping motor 51 is fixed to the casing 4*c* to which the holder 4*d* is also fixed. The stepping motor 51 is connected by an electric code 51*a* to the control device 16B. The stepping motor 51 has an output shaft 51*b* to which a proximal end of the swing arm 52 is fixed. The swing arm 52 has an elongated hole 52*a* formed in the distal end side thereof. The connecting shaft 53 is fixed to the outer cylinder 30 and inserted through the slit 4*f* to be engaged in the elongated hole 52*a*. The initial position switch 54 comprises a proximity switch fixed to the holder 4*d* so that the swing arm 52 comes close to the proximity switch. The initial position switch 54 is further connected by an electric code 54*a* to the control device 16B.

The control device 16B controls the liquid crystal display 6 so that the color of the currently set and projected sewing reference mark M is displayed in the same manner as the control device 16 in the first embodiment as shown in FIG. 15. In this case, the control device 16B computes a radius of the sewing reference mark M based on a signal supplied from the initial position switch 54 and an amount of drive of the stepping motor 51, controlling the liquid crystal display 6 so that the numeric value of the obtained radius and the sewing reference mark M with the currently set and displayed size, shape and color.

Furthermore, when wishing to change the size of the sewing reference mark M to a desired size, the operator touches the indication of "size change" on the touch panel 7. The control device 16B then controls the liquid crystal display 6 so that the mark size change screen as shown in FIG. 9 is displayed. For example, the numeric value of a radius of the desired size is displayed on the mark size change screen together with operation parts ("Δ" and "∇") for changing the numeric value. When the operator touches the operation parts ("Δ" and "∇") to display the numeric values of the radius of the desired size and the indication of "determined," the control device 16B controls the stepping motor 51 so that the projector lens 25 is raised and/or lowered together with the outer cylinder 30 in order that a sewing reference mark M of the desired size may be displayed.

The touch panel 7 serves as a mark size input unit which inputs the size of the sewing reference mark M. The stepping motor 51 serves as an actuator which drives the projector lens raising and lowering unit according to the size input by the mark size input unit. The mark size setting mechanism 36B changes the size of the circle Ma of the sewing reference mark M and set to a desired value and comprises the touch panel 7 and the stepping motor 51.

According to the workpiece cloth positioning guide device 18B of the third embodiment, the mark size setting mechanism 36B is provided with the touch panel 7 for inputting the size of the sewing reference mark M and the stepping motor 51 raising and lowering the projector lens 25 according to the size input on the touch panel 7. Accordingly, when the operator inputs the size of a desired sewing reference mark M on the touch panel 7, the projector lens 25 is raised and lowered by the stepping motor, whereby the sewing reference mark M with a desired size can promptly be projected. The other effect of the third embodiment is the same as those of the first and second embodiments.

Each of the workpiece cloth positioning guide devices 18, 18A and 18B of the first to third embodiments can be modified as follows.

In each of the projectors 15 and 15B, the optical penetration part 24 may be disposed so as to be inclined by a predetermined angle relative to the lengthwise direction of the inner cylinder 31 so that the circle Ma of the sewing reference mark M projected onto the workpiece cloth W from obliquely above becomes circular, and the circle forming pattern 33*a* may be formed into a circular shape.

A transparent plate may be provided instead of the mask member 32. The mark forming pattern 33 may be formed by painting the transparent plate in black or another color so that light is hard to pass through the plate.

In the raised or lowered position detecting mechanism 40 in the first embodiment or the raising and lowering drive mechanism 50 in the third embodiment, the potentiometer 41 or the stepping motor 51 may be coupled with the outer cylinder 30 by the use of a rack-and-pinion instead of the swing arm 42 or 52.

A ring-shaped member may be applied, instead of the presser foot 14. Furthermore, the cloth pressing part of the presser foot 14 may be made from a transparent resin material. Furthermore, each of the projectors 15 and 15B may project the sewing reference mark M using laser beams.

Additionally, modifications other than those described above may be added without departing from the gist of the invention. The workpiece cloth positioning guide device of the invention may be applied to various types of sewing machines.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A workpiece cloth positioning guide device for a sewing machine which includes a sewing bed on which workpiece cloth to be sewn is placed, a light source and a sewing needle, the device comprising:

a projector which projects a sewing reference mark onto an upper side of the workpiece cloth placed on the sewing bed of the sewing machine, wherein:

the projector includes a telescopic cylindrical body having an upper end provided with the light source and a lower end, a transmission part provided in a lengthwise middle portion of the cylindrical body and formed with a mark forming pattern for forming the sewing reference mark, a projector lens provided in the lower end of the cylindrical body, and a projector lens elevating unit which raises and lowers the projector lens;

the projector irradiates the workpiece cloth with light emitted by the light source toward a needle drop reference point of the sewing needle of the sewing machine from obliquely above so that the sewing reference mark is projected, the sewing mark including a circle display portion and a center display portion that is a center of the circle display portion and corresponds with the needle drop reference point, both portions being formed on the upper side of the workpiece cloth;

the circle display portion of the sewing reference mark guides positioning of the workpiece cloth in sewing, and the center display portion guides the needle drop reference point of the sewing needle of the sewing machine; and the projector includes a mark size setting unit which sets a size of the circle of the sewing reference mark to a desired size, the mark size setting unit changes the size of the sewing reference mark by raising or lowering the projector lens by the projector lens elevating unit.

2. The workpiece cloth positioning guide device according to claim 1, further comprising a mark size display unit which displays the size of the sewing reference mark set by the mark size setting unit.

3. The workpiece cloth positioning guide device according to claim 1, wherein the mark size setting unit includes a mark size inputting unit which inputs the size of the sewing reference mark and an actuator which drives the projector lens elevating unit according to the size input by the mark size inputting unit.

4. The workpiece cloth positioning guide device according to claim 1, wherein the projector is set with a shape of the mark forming pattern or a predetermined position of the transmission part relative to the cylindrical body so that the circle of the sewing reference mark has a predetermined circularity.

5. The workpiece cloth positioning guide device according to claim 1, wherein the center display portion of the sewing reference mark includes a cross having an intersection at the needle drop point.

6. The workpiece cloth positioning guide device according to claim 1, further comprising a mark color changing unit which changes a color of the sewing reference mark to be projected by the projector to one of a plurality of colors.

* * * * *